US006487885B2

(12) United States Patent
Meisser et al.

(10) Patent No.: US 6,487,885 B2
(45) Date of Patent: Dec. 3, 2002

(54) METHOD AND APPARATUS FOR PRODUCING A CRIMPED CONNECTION

(75) Inventors: Claudio Meisser, Cham (CH); Hilmar Ehlert, Lucerne (CH)

(73) Assignee: Komax Holding AG, Dierikon (CH)

( * ) Notice: Subject to any disclaimer, the term of this patent is extended or adjusted under 35 U.S.C. 154(b) by 0 days.

(21) Appl. No.: 09/973,381

(22) Filed: Oct. 9, 2001

(65) Prior Publication Data

US 2002/0050159 A1 May 2, 2002

(51) Int. Cl.[7] ..... H01R 43/04; B21D 9/08

(52) U.S. Cl. ..... 72/20.1; 72/21.1; 72/21.4; 72/21.5; 72/441; 72/446; 29/753; 29/857; 29/863

(58) Field of Search ..... 29/753, 863, 857; 72/20.1, 21.1, 19.8, 21.4, 21.5, 19.9, 441, 446

(56) References Cited

U.S. PATENT DOCUMENTS 3,931,727 A * 1/1976 Luenser ..... 72/21.1
4,856,186 A * 8/1989 Yeomans ..... 29/863
4,916,810 A * 4/1990 Yeomans ..... 29/863
5,027,631 A * 7/1991 Naito ..... 72/21.5
5,069,060 A * 12/1991 Ishii ..... 72/14.8
5,092,026 A * 3/1992 Klemmer et al. ..... 29/863
5,197,186 A * 3/1993 Strong et al. ..... 29/753
5,271,254 A * 12/1993 Gloe et al. ..... 72/19.9
5,337,589 A * 8/1994 Gloe et al. ..... 29/753
5,522,244 A 6/1996 Eigenmann et al.
5,588,344 A 12/1996 Chun
5,669,257 A 9/1997 Inoue et al.
5,727,409 A * 3/1998 Inoue et al. ..... 29/753
5,966,806 A * 10/1999 Maeda et al. ..... 29/863

* cited by examiner

*Primary Examiner*—David Jones
(74) *Attorney, Agent, or Firm*—Schweitzer Corman Gross & Bondell LLP

(57) ABSTRACT

A crimping press provides increased accuracy and precision. Both a rotative measuring system, such as an encoder arranged at a motor shaft, and a linear measuring system such as, for example, a measuring head and a glass scale, are provided. The linear measuring system may be coupled between a tool holder and the fixed press stand. The measurement values generated by the rotative measuring system and the measuring values of the linear measuring system are fed to a regulating circuit for regulation of crimping height.

4 Claims, 8 Drawing Sheets

METHOD AND APPARATUS FOR PRODUCING A CRIMPED CONNECTION

The invention relates to a method and apparatus for controlling a crimping process serving for the connection of a contact with a conductor, wherein a crimping tool of a crimping press is movable from a starting position into a crimping position and subsequently into an end position.

BACKGROUND OF THE INVENTION

Equipment for producing a crimped connection has become known from U.S. Pat. No. 5,966,806. A motor drives an eccentric shaft which moves a carriage with crimping tools up and down. An encoder driven by means of the motor shaft serves for positional determination of the crimping tool. The crimp contact to be connected with a conductor end lies on a stationary anvil, wherein lugs of the crimp contact are plastically deformed on downward movement of the crimping tool and produce the connection to the conductor. The position of the crimping tool in the crimping region is measured by means of a height sensor, wherein the sensor signal is used independently of the encoder signal. At the same time the crimping force is measured on the basis of the motor current. The measurement values are compared with reference values. The comparison enables a statement about the crimp quality.

Although an encoder and a height sensor are present, only a relatively imprecise statement about the crimp quality can be made, because external influences as well as the degree of elasticity or rigidity of the mechanical driven elements are not taken into consideration.

The present invention avoids the disadvantages of the known equipment and is accordingly directed to a method and apparatus in which the crimp quality of a crimped connection can be improved.

BRIEF DESCRIPTION OF THE INVENTION

The advantages achieved by the invention are essentially to be seen in that alteration of the crimping press is not necessary for processing different crimp contacts by different tool strokes. The crimping height and the crimping stroke are adjustable. Moreover, the crimping press control recognizes the exact tool position each time the press is activated, whereby a simple evaluation of the crimping force versus crimping stroke can be made and other machines participating in the crimping process can be synchronized.

The crimping press according to the invention operates with two measuring systems, by means of which a regulation of the drive with respect to position or crimping height regulation can be obtained. A rotative measuring system is coupled with a linear measuring system. The rotative measuring system enables a high positioning dynamic, because no dead times, caused by play in gears, levers or slides, are present. The linear measuring system enables precise crimp height regulation. Mechanically-caused tolerances of the crimping press, which may be due to, for example, crimping force or temperature fluctuations, are compensated for by the crimp height regulation. With the crimp height regulation the eccentric of the crimping press moves an angular range between 0° and 180° as limits. The crimping press stops at the lower dead center and subsequently reverses. Upper and lower dead center positions can be moved to as desired within the 0°–180° angular range according to the respective crimping tool and crimp contact utilized. Intermediate stop positions are also possible. For realization of this feature only a regulated axis is necessary, and the carriage stroke or crimping height can be programmed. Moreover, the course of the crimping force as a function of the crimping stroke can be represented exactly and is usable for quality control purposes.

BRIEF DESCRIPTION OF THE DRAWINGS

The present invention is more fully described by the following detailed description when considered with reference to the accompanying figures, in which.

DETAILED DESCRIPTION OF THE INVENTION

Figure 1:
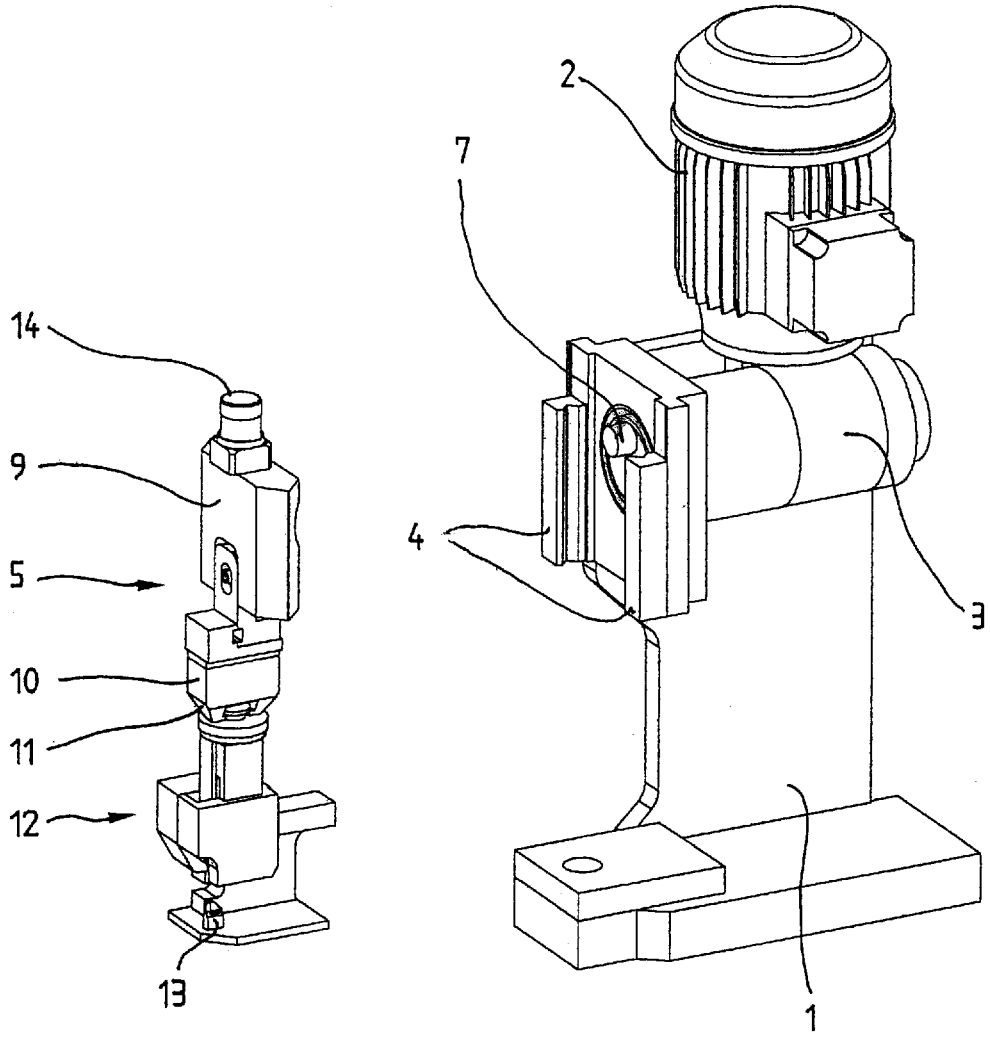
FIG. 1 shows a crimping press with a tool for production of a crimped connection.

In FIG. 1 there is designated by 1 a stand, shown without a righthand side wall, upon which a motor 2 and a transmission 3, which is mounted at the stand 1, are arranged. Moreover, first guides 4, by which a crimping bar 5 is guided, are arranged at the stand 1. A shaft 6 driven by the transmission 3 has an eccentric pin 7 at one end. The crimping bar 5 consists of a carriage 9 guided in the first guides 4 and a tool holder 10 with a retaining fork 11. The carriage 9 stands in loose connection with the eccentric pin 7, wherein the rotational movement of the eccentric pin 7 is converted into a linear movement of the carriage 9. The maximum stroke H of the carriage 9 is determined by the upper dead center and the lower dead center of the eccentric pin 7. The tool holder 10 actuates a tool 12, which, together with an anvil 13 belonging to the tool 12, produces the crimped connection. The shut height at the lower dead centre of the eccentric pin 7 can be precisely adjusted by means of an adjusting screw 14. If no adjusting wheel is provided at the tool 12, the crimping height (distance between the anvil 13 and crimping ram at the lower dead center of the eccentric pin 7) can be adjusted by the adjusting screw 14.

Figure 3:
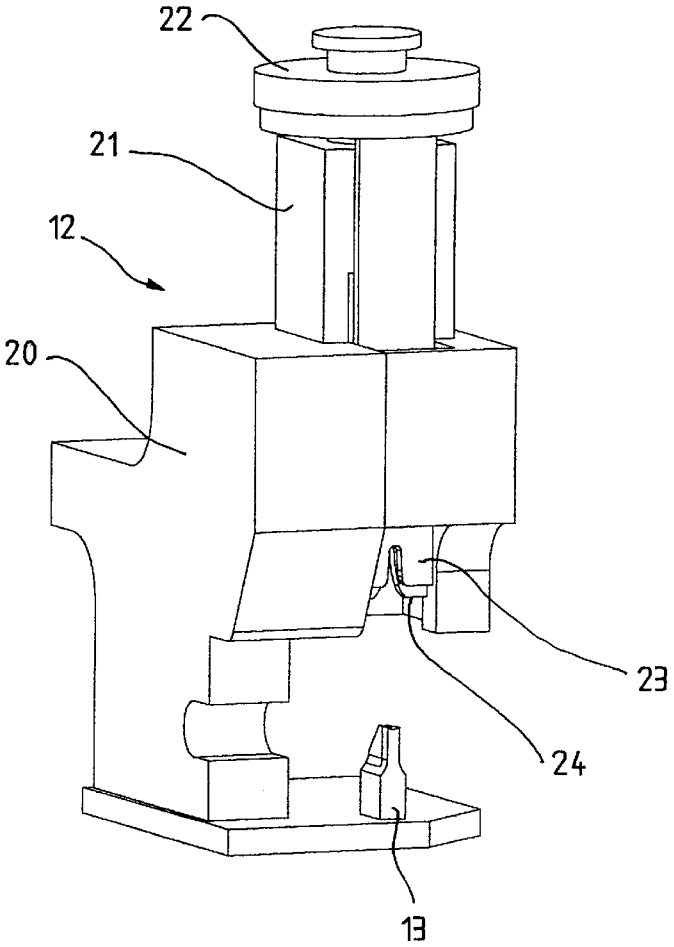
FIG. 3 shows the tool with the crimping ram in the upper dead center position.
Figure 2:
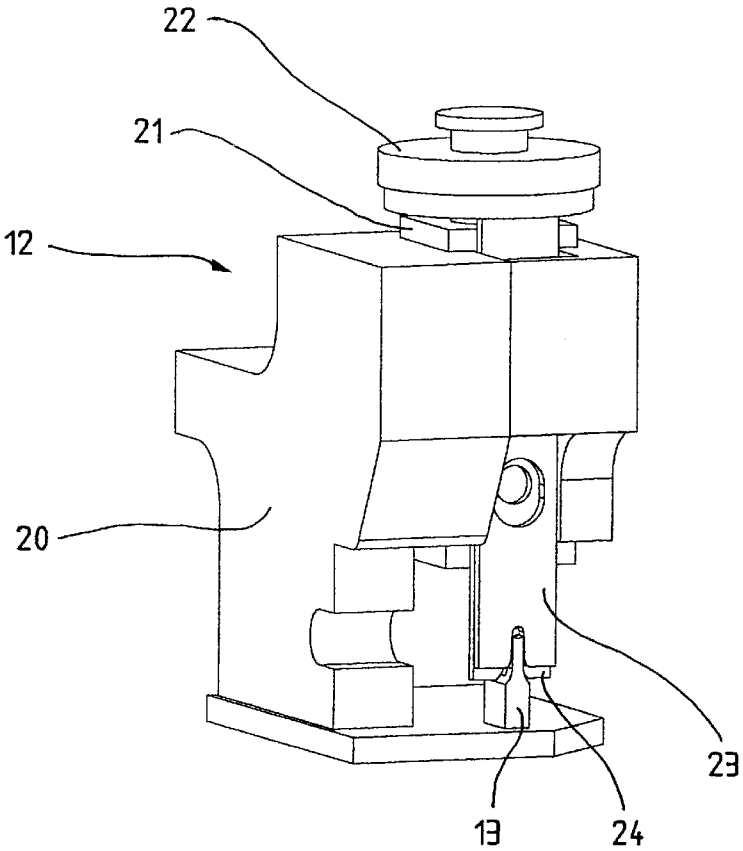
FIG. 2 shows the tool with a crimping ram in the lower dead center position.

FIGS. 2 and 3 show details of the tool 12 for production of a crimped connection. A ram carrier 21 guided in a tool housing 20 has a carrier head 22, which stands in loose connection with the retaining fork 11 of the tool holder 10. A first crimping ram 23 and a second crimping ram 24 are arranged at the ram carrier and produce, together with the correspondingly constructed anvil 13, the crimped connections. FIG. 2 shows the crimping rams 23, 24 at the lower dead centre position of the eccentric pin 7, at which the production of the crimped connection is concluded. FIG. 3 shows the crimping rams 23, 24 in the upper dead center position of the eccentric pin 7. The maximum ram stroke is determined by the two dead center positions.

Figure 4:
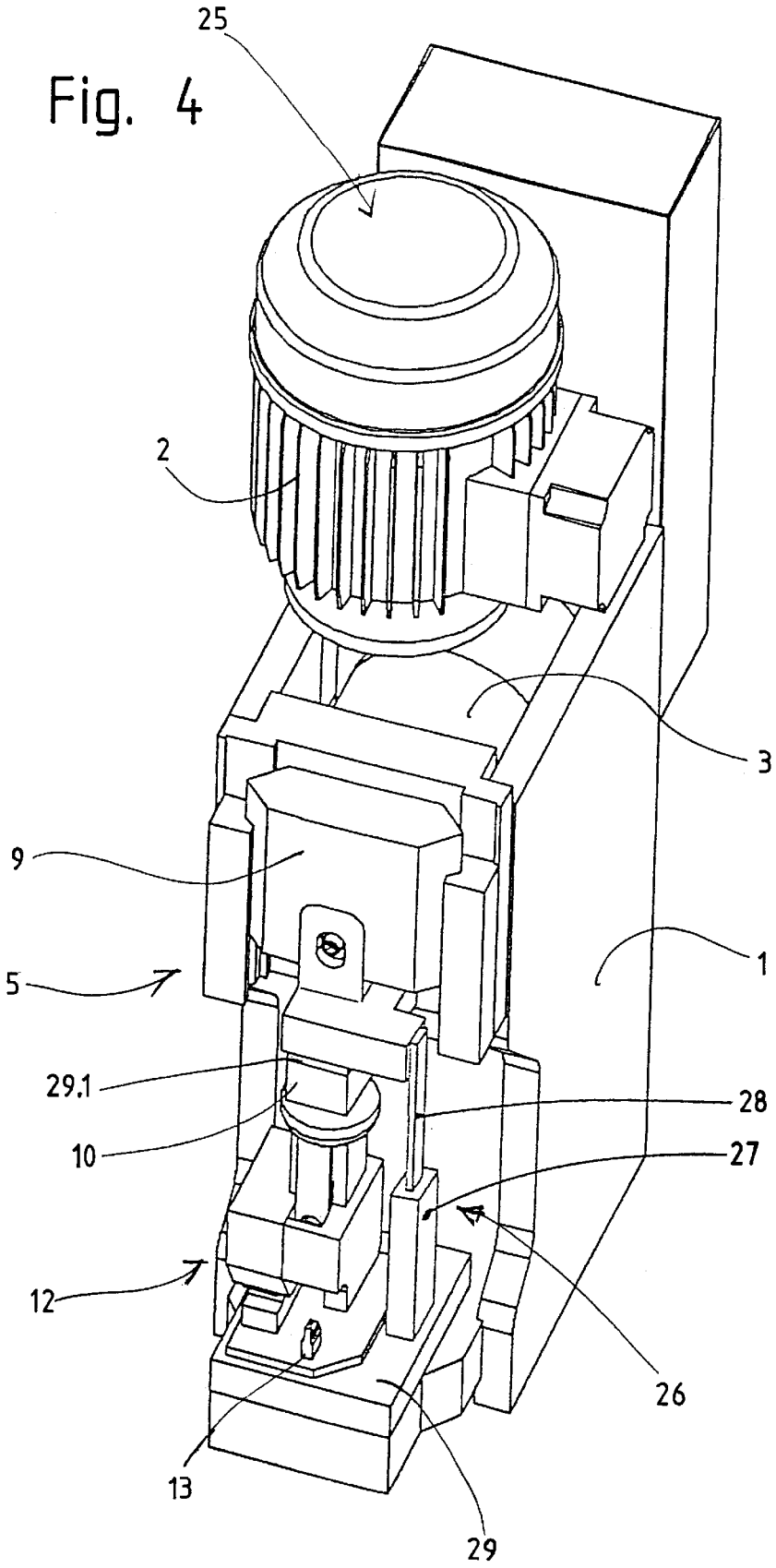
FIG. 4 shows the crimping press with a rotative measuring system and a linear measuring system.

FIG. 4 shows the crimping press with a rotative measuring system 25 arranged at the motor 2, for example an encoder arranged at the motor shaft, and with a linear measuring system 26, consisting of, for example, a measuring head 27 and a glass scale 28. The glass scale 28, which is provided with a graduation, is connected at one end with the tool holder 10. At the other end the glass scale 28 extends into the measuring head 27, which is fixedly connected with the stand foot 29. Moreover, a force sensor 29.1 for measuring the crimping force is provided at the tool holder 10.

Figure 5:
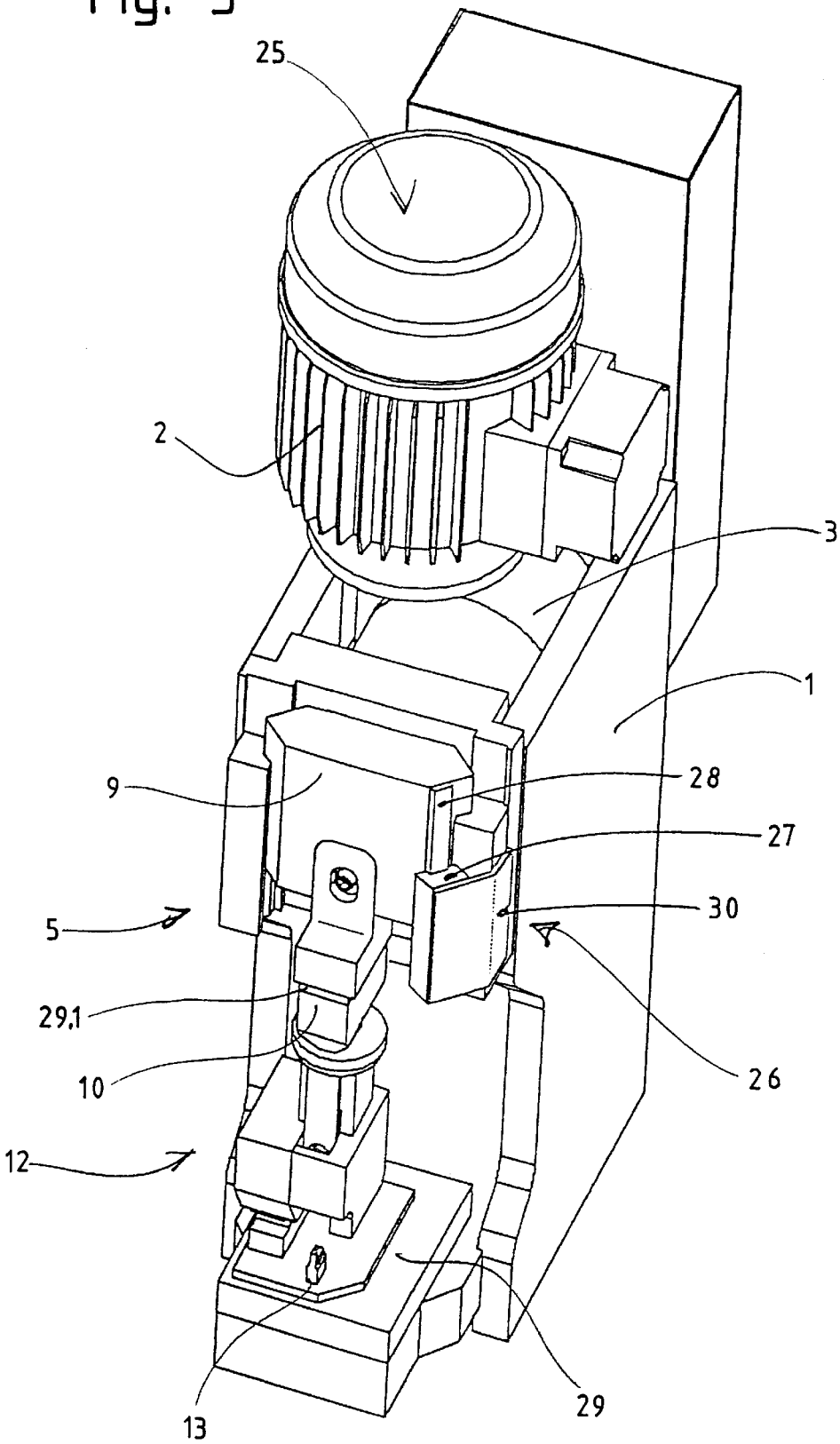
FIG. 5 shows a variant of the arrangement of the linear measuring system.

FIG. 5 shows a variant of arrangement of the linear measuring system 26, wherein the measuring head 27 is arranged at a stationary holder 30 and the glass scale 28 is connected at one end with the carriage 9. In this variant of arrangement there is no compensation for the opening of the crimping press. However, this value is very small relative to the play in the bearings and the levels of rigidity of the transmission, shafts and levers.

In a further variant of arrangement the linear measuring system 26 can be arranged at or in the crimping tool 12. This arrangement enables a very precise detection of the crimping height.

Figure 6:
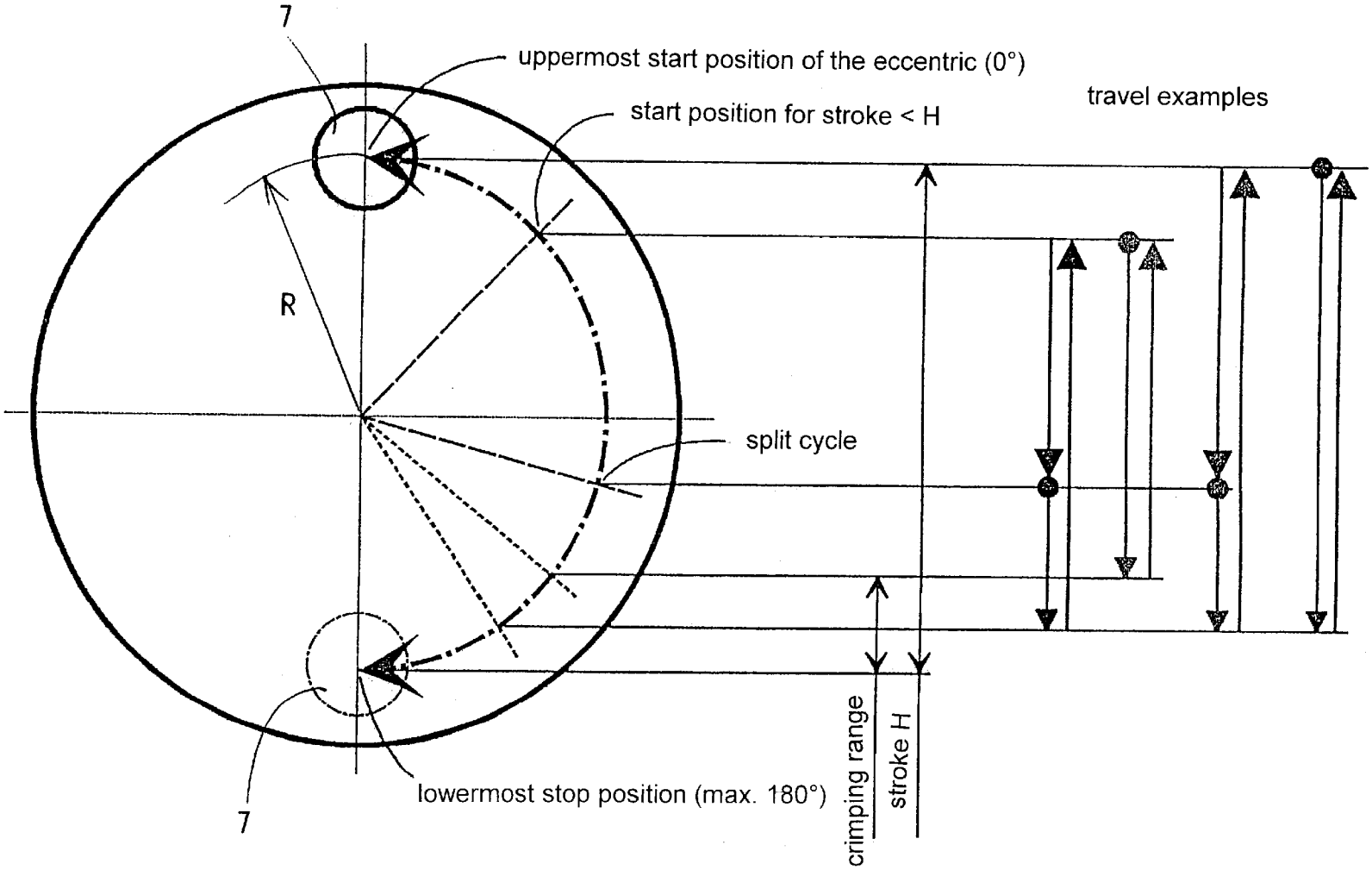
FIG. 6 shows a schematic illustration of eccentric movement and carriage movement.

FIG. 6 shows schematically the movement of the eccentric and the movement of the carriage for a stroke H of, for example, 40 millimeters, wherein the eccentric pin 7 rotates from 0° (uppermost starting position or upper dead center) to 180° (lowermost stop position or lower dead center) and back again to 0°, wherein the path of travel does not run through between 180° and 360°. Start positions deviating from 0° and intermediate stops (split cycles) on the travel between 0° and 180° are also possible. The 180° position of the eccentric pin 7 corresponds with a minimum crimping height (small crimp contacts with small wire cross-sections). In order that re-adjustment is possible, the crimpings should occur before 180°. The point of reversal can lie before 180°, which then corresponds with a maximum crimping height (large crimp contacts with large wire cross-sections). FIG. 6 shows different examples of travel of the carriage 9 or the tool 12 with and without intermediate stops. Intermediate stops are introduced for, for example, centring particular crimp contacts or synchronisation with other cable processing equipment.

Figure 7:
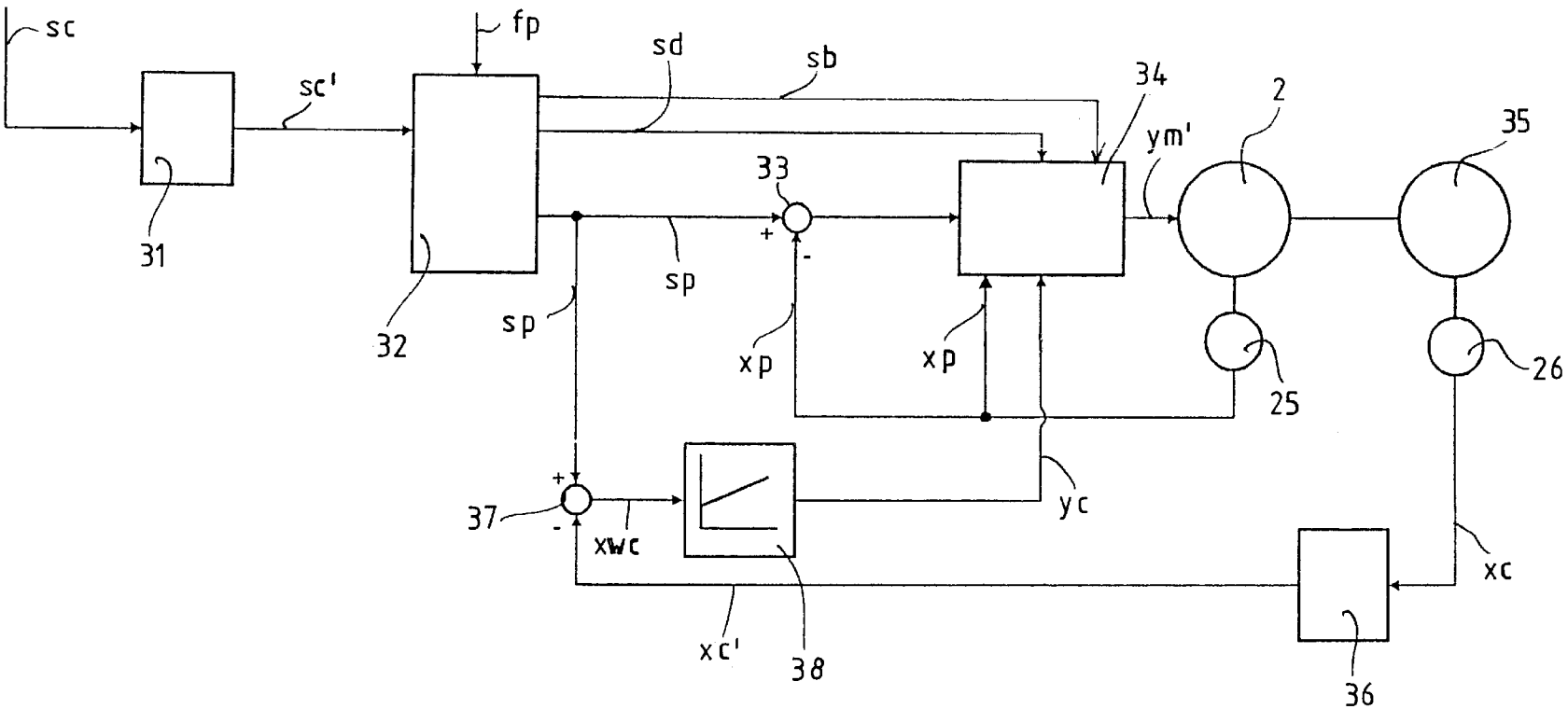
FIG. 7 shows a schematic illustration of a regulating circuit for crimp height regulation.

FIG. 7 shows a schematic illustration of a regulating circuit for crimping height regulation. The regulating circuit essentially consists of a motor position circuit with the rotative measuring system 25 and a crimping height regulating circuit with the linear measuring system 26. A signal sc as a target value for the crimping height is predetermined in dependence on the size of the crimp contact to be processed. The signal sc for the target value of the crimping height is converted by means of a first converter 31 into a dimension used in the regulating circuit (transformation of linear values into rotative values). The converted signal is denoted by sc' and is applied to the input of a travel curve generator 32. In addition, travel parameters fp, such as, for example, maximum values for speed, acceleration or retardation, are also fed to the travel curve generator 32. A signal sp as a target value for the motor position is available at the output of the travel curve generator 32. The signal sp is fed to a first summation point 33 at its + input. A signal xp as an actual value for the motor position is applied to the − input of the first summation point 33. With respect to regulating technology the signal xp is termed a regulating magnitude and is produced by the rotative measuring system 25. The signal xwp, which is also termed regulating deviation and which is applied to the input of a switching circuit 34 (explained in more detail in FIG. 8), arises at the output of the first summation point 33 from the difference of the signal sp and the signal xp. The signal ym' is the setting magnitude for the motor 2, to which the rotative measuring system 25 is coupled. In addition, the signals sd as a target value for motor rotational speed, sb as a target value for motor acceleration and xp as the actual value for the motor position are fed to the switching circuit 34.

The motor 2 drives a mechanism 35 consisting of the transmission 3 with eccentric pin 7, guides 4, crimping bar 5 and tool 12. With regard to disturbance magnitudes for the regulating circuit, the stand 1 together with the anvil 13 is also to be taken into consideration. The linear measuring system 26, connected with the tool holder 10 and the stand 1, produces a signal xc as an actual value for the instantaneous position of the tool holder 10 or for the crimping height. The signal xc for the actual value of the crimping height is converted by means of a second converter 36 into a dimension used in the regulating circuit (transformation of linear values into rotative values). The converted signal is denoted by xc' and is applied to the − input of a second summation point 37. The signal sp as the target value for the motor position is also applied to the + input of the second summation point 37. With respect to regulating technology the signal xc' is termed regulating magnitude. The signal xwc, which is also termed regulating deviation and is fed to the input of a crimping height regulator 38, arises at the output of the second summation point 37 from the difference of the signal sp and the signal xc'. The crimping height regulator 38, which, for example, is provided with a proportional/integral characteristic, produces at its output a signal yc which is also termed setting magnitude and is fed to the switching circuit 34.

Mechanically induced disturbance magnitudes (opening of the crimping press, play in the bearings and degrees of elasticity or rigidity of the transmission, the shafts and lever) are compensated for by the crimping height regulator 38 and the linear measuring system 26.

Figure 8:
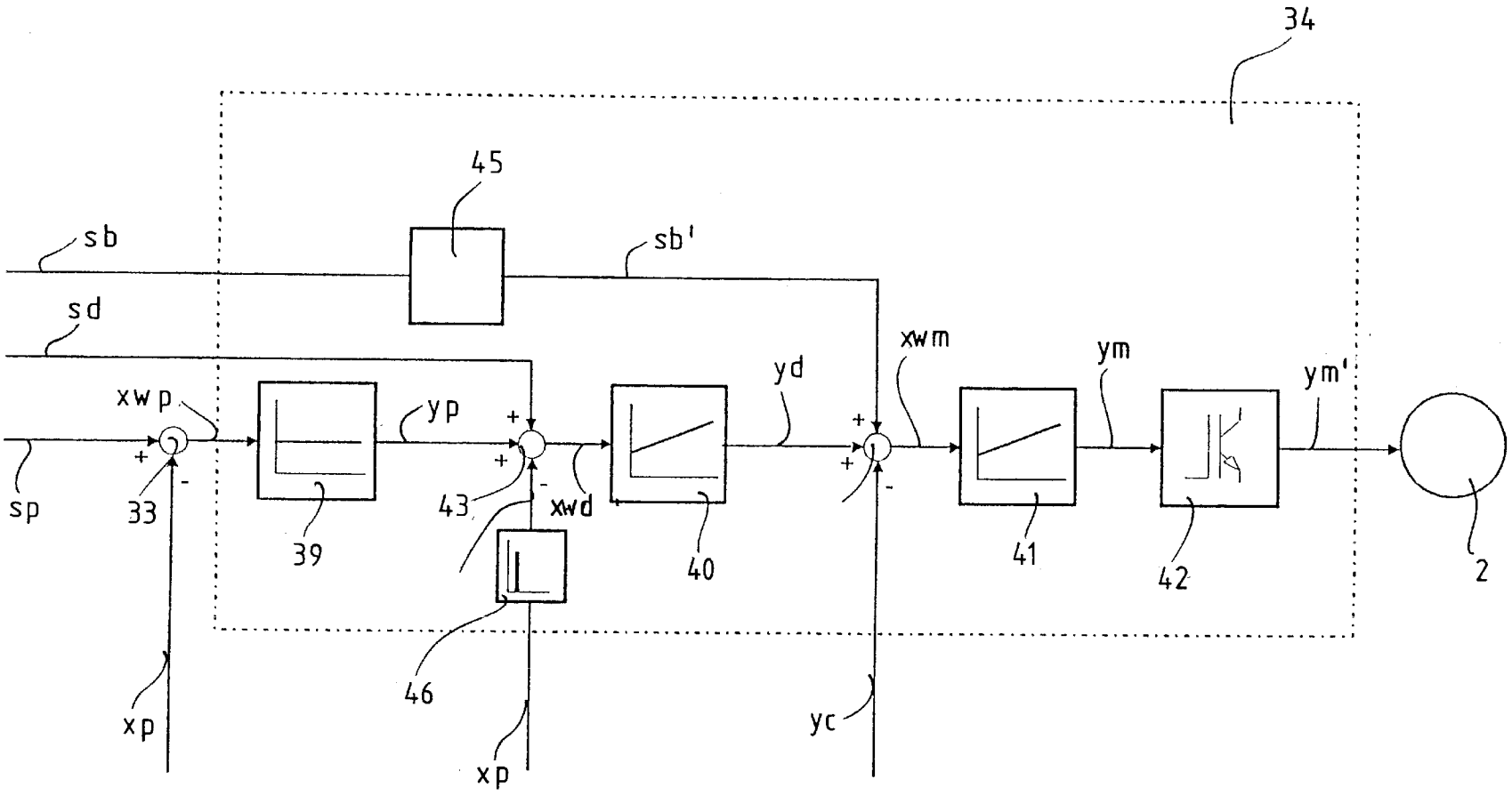
FIG. 8 shows a schematic illustration further detailing the regulating circuit according to FIG. 7.
Figure 9:
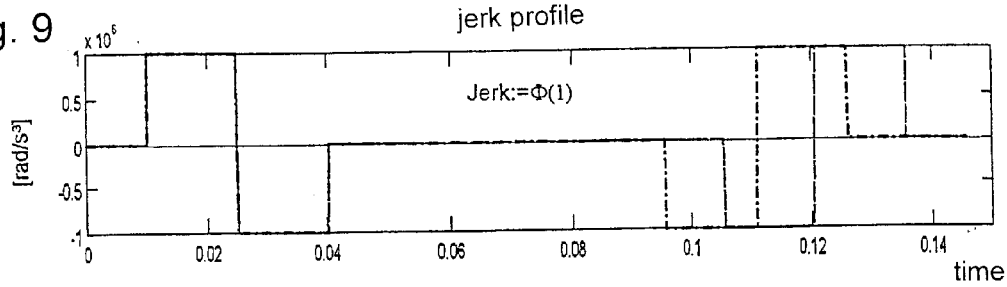
FIGS. 9, 10, 11, 12 and 13 each show travel curves for movement of the crimping tool.
Figure 10:
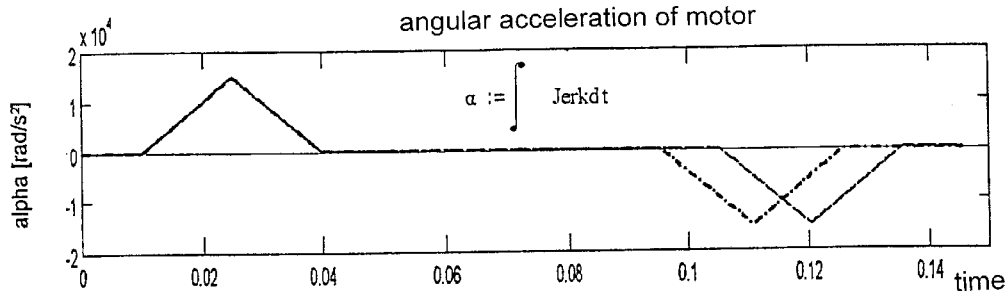
Figure 11:
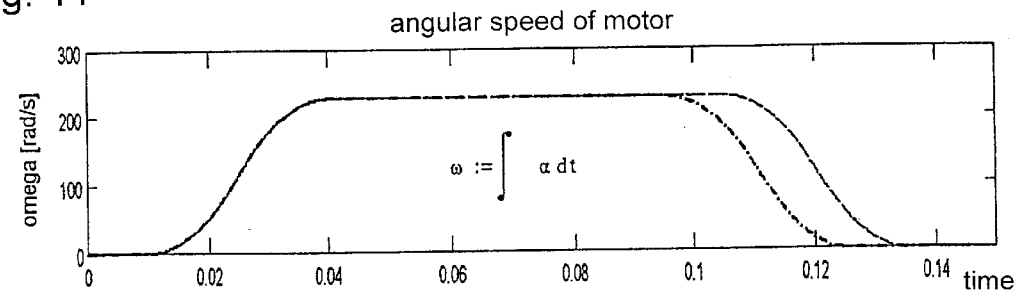
Figure 12:
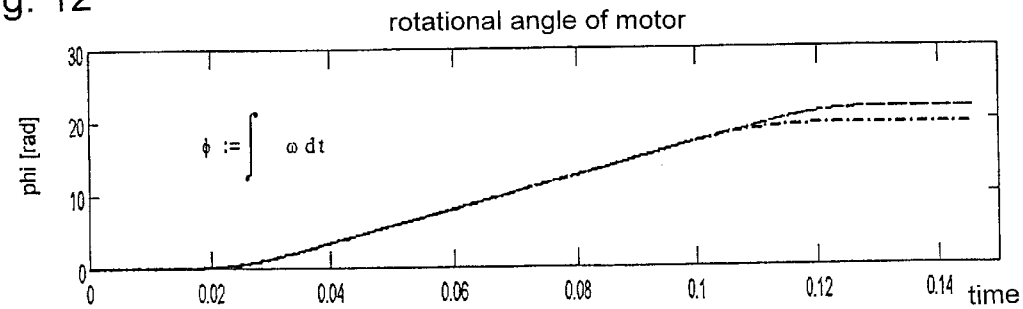
Figure 13:
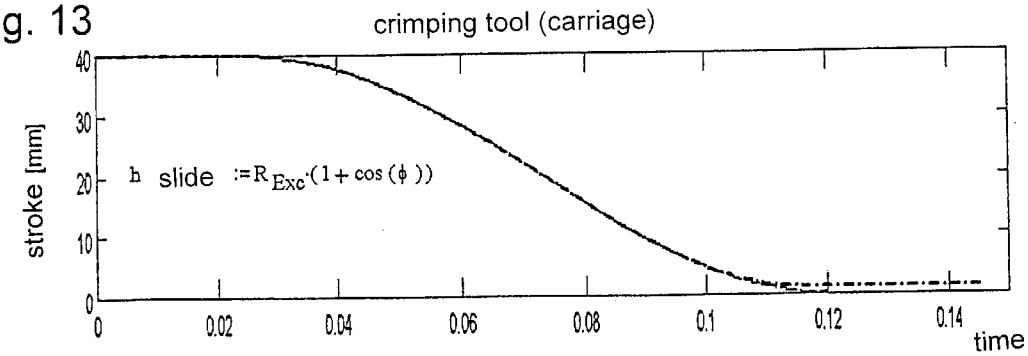

FIG. 8 shows details of the switching circuit 34, which comprises a position regulator 39, a rotational speed regulator 40, a torque regulator 41 and the electronic power unit 42 for the motor 2. The signal xwp is applied to the input of the position regulator 39. The position regulator 39, which is provided with, for example, a proportional characteristic, produces at its output a signal yp which is fed to the + input of a third summation point 43. The target value signal sd for the motor rotational speed is applied to a further + input and the actual value xd for the motor rotational speed is applied to the − input. xd is produced by means of a third converter 46, which is provided with a differential characteristic, from the actual value signal xp for motor position. The signal xwd, which is applied to the input of the rotational speed regulator 40, arises at the output of the third summation point 43. The rotational speed regulator 40, which is provided with, for example, a positive/integral characteristic, produces at its output a signal yd which is fed to the + input of a fourth summation point 44. The target value sb' for motor acceleration is applied to a further + input and the output signal yc of the crimp height regulator 38 is applied to the − input. The target value sb for the motor acceleration is converted by means of a fourth converter 45 into a dimension used in the regulating circuit. The converted signal is denoted by sb'. The signal xwm, which is fed to the input of the torque regulator 41, arises at the output of the fourth summation point 44. The torque regulator 41, which is provided with, for example, a proportional/integral characteristic, produces at its output a signal ym which is fed to the input of the electronic power unit 42. In dependence on the signal ym the electronic power unit 42 supplies the motor 2 with the setting magnitude ym' or with energy.

FIGS. 9 to 13 show travel curves, which are generated by the travel curve generator 32, as target values predetermination for the movement of the crimping tool 12 on the basis of a first example illustrated by dashed lines and a second example illustrated by chain-dotted lines. The jerk profile jerk=kickback function $\phi$ with the values 1, 0, −1) of FIG. 9 causes and influences the rounding of the profile of FIG. 11. In the shown example the Heaviside function is such that the angular speed of the motor is flattened to half the speed increase or speed decrease, which ensures a jerk-free transition from a changing angular speed to a constant angular speed or conversely. The carriage stroke is dependent on the radius R of the eccentric and on a cosine function of the motor rotational angle.

We claim:

1. A method of controlling a crimping process for the connection of a crimp contact with a conductor, comprising moving a crimping tool of a crimping press from a selectable starting position to a selectable crimping position and subsequently returning the crimping tool to the starting position while regulating the movement of the crimping tool by a regulating circuit utilizing independently generated measurement values of motor rotation and crimping tool linear position.

2. The method according to claim 1, wherein the measurement values for crimping tool linear position are obtained from a monitoring of at least one of the crimping tool or a crimping tool carriage.

3. Apparatus for producing a crimped connection by means of a crimping tool driven by a motor, comprising a rotative measuring system for detecting movement of the motor and for generating rotative measuring values associated therewith, an independent linear measuring system for detecting the movement of the crimping tool and generating linear measuring values associated therewith, and a regulating circuit for receiving the rotative and linear measurement values and regulating crimping height.

4. The apparatus according to claim 3, further comprising a travel curve generator for producing position signals, rotational speed signals and acceleration signals which are applied to the regulating circuit as target values, wherein the regulating circuit regulates the crimping height by processing the target values and the rotative and linear measurement values.

* * * * *